US007011062B2

(12) United States Patent
Sanada et al.

(10) Patent No.: US 7,011,062 B2
(45) Date of Patent: Mar. 14, 2006

(54) ENGINE STARTING APPARATUS

(75) Inventors: Makoto Sanada, Saitama (JP); Minoru Matsuda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 588 days.

(21) Appl. No.: 10/067,198

(22) Filed: Feb. 7, 2002

(65) Prior Publication Data

US 2002/0104499 A1 Aug. 8, 2002

(30) Foreign Application Priority Data

Feb. 7, 2001 (JP) ..... 2001-030706
Oct. 30, 2001 (JP) ..... 2001-333345

(51) Int. Cl.
*F02N 17/00* (2006.01)

(52) U.S. Cl. ..... 123/129.3; 123/90.11

(58) Field of Classification Search ..... 123/179.3, 123/179.5, 182.1, 179.16, 179.17, 179.18, 123/179.1, 90.11
See application file for complete search history.

(56) References Cited

U.S. PATENT DOCUMENTS 4,248,192 A * 2/1981 Lampard ..... 123/256
4,773,382 A * 9/1988 Smith et al. ..... 123/661
4,790,271 A * 12/1988 Onda ..... 123/182.1
5,101,780 A * 4/1992 Jones ..... 123/182.1
5,219,397 A * 6/1993 Jones ..... 123/179.3
5,349,929 A * 9/1994 Shimizu et al. ..... 123/90.16
5,713,320 A * 2/1998 Pfaff et al. ..... 123/179.3
5,755,137 A * 5/1998 Tomida ..... 74/7 E
6,202,499 B1 * 3/2001 Brinn ..... 74/329
6,357,409 B1 * 3/2002 Haghgooie et al. ..... 123/179.3
6,396,165 B1 * 5/2002 Nagano et al. ..... 307/10.6

FOREIGN PATENT DOCUMENTS

JP 4-148008 5/1992
JP 3070086 5/2000

* cited by examiner

*Primary Examiner*—Carl S. Miller
(74) *Attorney, Agent, or Firm*—Birch, Stewart, Kolasch & Birch, LLP

(57) ABSTRACT

To attain downsizing and weight reduction of a starter motor and starting power transmission in an engine starting apparatus. The starting power transmission decelerates rotation power of the starter motor and transmits the power to a crankshaft, even in a multi-cylinder engine. The starting power transmission is provided between the starter motor that starts rotation by electric power supplied from a battery and the crankshaft. An exhaust valve is depressed and opened by actuation of an actuator in accordance with actuation of the starter motor. The actuation of the actuator is continued until the number of revolutions of the crankshaft detected by a revolution detector reaches a predetermined number of revolutions.

26 Claims, 4 Drawing Sheets

ENGINE STARTING APPARATUS

CROSS-REFERENCES TO RELATED APPLICATIONS

This nonprovisional application claims priority under 35 U.S.C. § 119(a) on Patent Application Nos. 2001-030706 and 2001-333345 filed in Japan on Feb. 7, 2001 and Oct. 30, 2001, respectively, the entirety of which is herein incorporated by reference.

BACKGROUND OF THE INVENTION

1. Field of the Invention

The present invention relates to an engine starting apparatus. In particular, the present invention relates to an engine starting apparatus in which a starting power transmission is provided between a starter motor and a crankshaft. The starter motor rotates by electric power supplied from a battery. The starting power transmission decelerates the rotation power of the starter motor and transmits the power to the crankshaft.

2. Description of Related Art

Conventionally, such apparatus is already well known by e.g. Japanese Patent No. 3070086. In this apparatus, in a mono-cylinder engine, the starter motor and starting power transmission means are downsized without setting excessively high strength by providing a torque limiter mechanism in a starting power transmission. The torque limiter protects the starter motor against reverse operation of the crankshaft upon engine startup.

Furthermore, as disclosed in e.g. Japanese Published Unexamined Patent Application No. Hei 4-148008, the starter motor and starting power transmission are downsized without setting an excessively high strength. The starter motor is prevented against reverse operation of the crankshaft by opening an exhaust valve through a decompression device in an initial compression stroke upon startup of mono-cylinder engine.

In a mono-cylinder engine, as in the case of the above-described conventional art, the starter motor and starting power transmission can be downsized by providing a torque limiter mechanism or decompression device. However, it is difficult to apply the above conventional art construction to a multi-cylinder engine without any change. Specifically, in a multi-cylinder engine, ignition is made at an early timing in spite of a great amount of inertia of the crankshaft. Accordingly, the crankshaft cannot be started without difficulty unless a limiter weight is set to a large value. Furthermore, the decompression device cannot be actuated within a range of a small crank angle without difficulty, and the downsizing and weight reduction of the starter motor and starting power transmission in the multi-cylinder engine cannot be attained without difficulty.

SUMMARY OF THE INVENTION

The present invention has been made in view of the above situation, and has as its object to provide an engine starting apparatus which attains downsizing and weight reduction of a starter motor and starting power transmission even in a multi-cylinder engine.

To attain the foregoing object, the present invention is directed to an engine starting apparatus, wherein a starting power transmission is provided between a starter motor and a crankshaft. The starter motor rotates by electric power supplied from a battery. The starting power transmission decelerates the rotation power of the starter motor and transmits the power to the crankshaft. The engine starting apparatus includes a decompression device for depressing an exhaust valve to open the exhaust valve, in correspondence with actuation of an actuator; a revolution detector that detects the number of revolutions of the crankshaft; and a controller for controlling the actuation of the actuator by starting the actuation of said actuator in accordance with the actuation of the starter motor and continuing the actuation of said actuator until the number of revolutions detected by the revolution detector reaches a predetermined number of revolutions.

According to this construction, the power from the starter motor is transmitted via the starting power transmission to the crankshaft in correspondence with the actuation of the starter motor. Since the actuator of the decompression device starts in accordance with the actuation of the starter motor and the exhaust valve is depressed to open the exhaust valve, the pressure in a combustion chamber during an engine compression stroke is reduced, and the engine starting torque can be greatly reduced. Furthermore, the open status of the exhaust valve depressed by the decompression device ends when the number of revolutions of the crankshaft has reached the predetermined number of revolutions. Since the crankshaft has a sufficient inertia even when the combustion chamber pressure in the engine compression stroke increases to a normal state, the engine can be reliably started. In this manner, since the starting torque necessary upon engine startup can be reduced, and the decompression device is continuously actuated until the number of revolutions of the crankshaft reaches the predetermined number of revolutions regardless of ignition timing, the downsizing and weight reduction of the starter motor and starting power transmission can be attained even in a multi-cylinder engine.

Furthermore, the present invention includes, in addition to the construction of the present invention described above, the starting power transmission provided with a one-way clutch having a clutch member as one constituent that rotates at a speed higher than that of the crankshaft and that is always coupled to the crankshaft. According to this construction, the comparatively large inertia produced by the clutch member as one constituent of the one-way clutch is effectively utilized as inertia of the crankshaft. Accordingly, startup of the engine can be improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinbelow, a working example of the present invention will be described in accordance with an embodiment of the present invention illustrated in the attached drawing.

Figure 1:
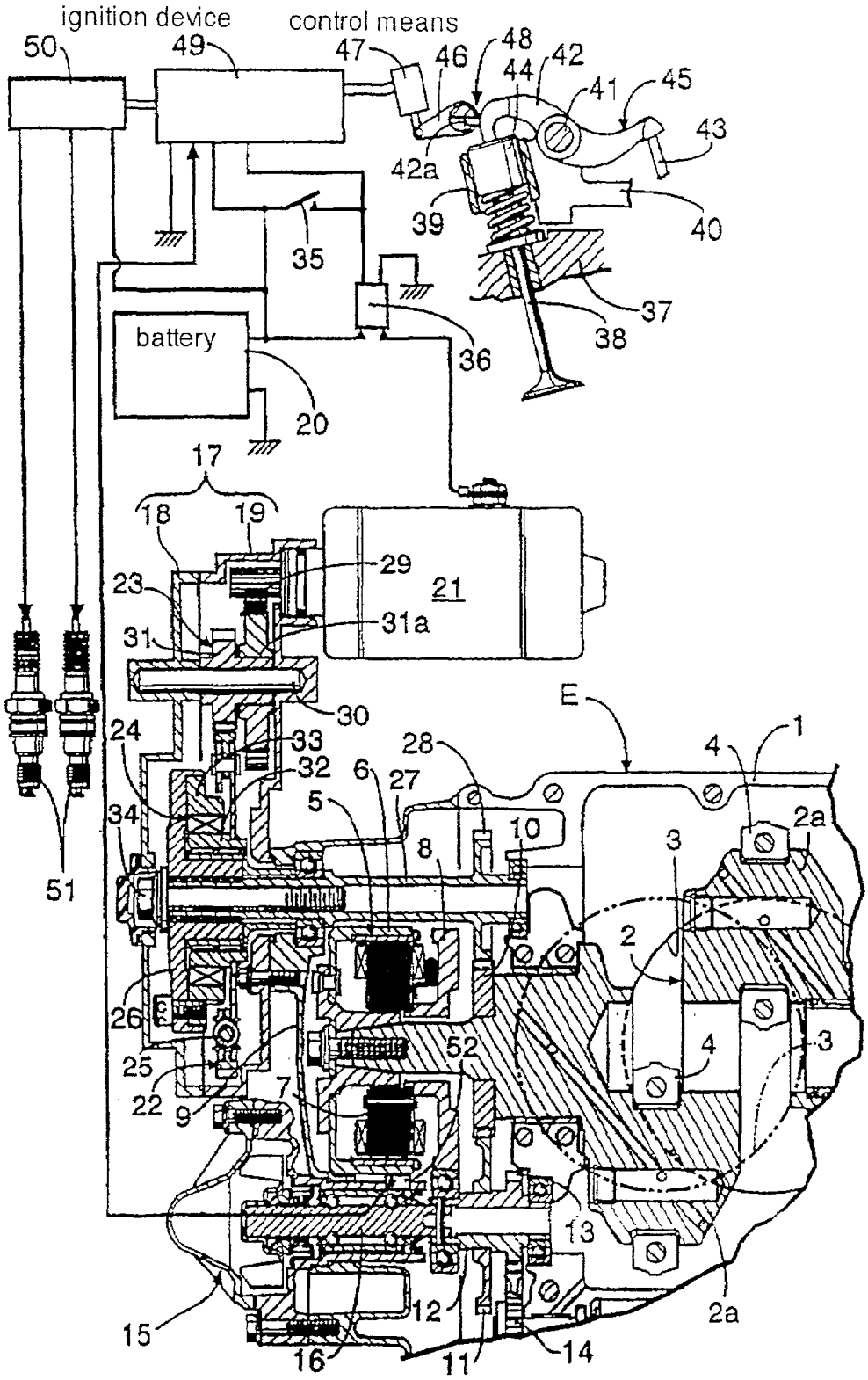
FIG. 1 is a cross-sectional view of a part of the structure of the engine.
Figure 2:
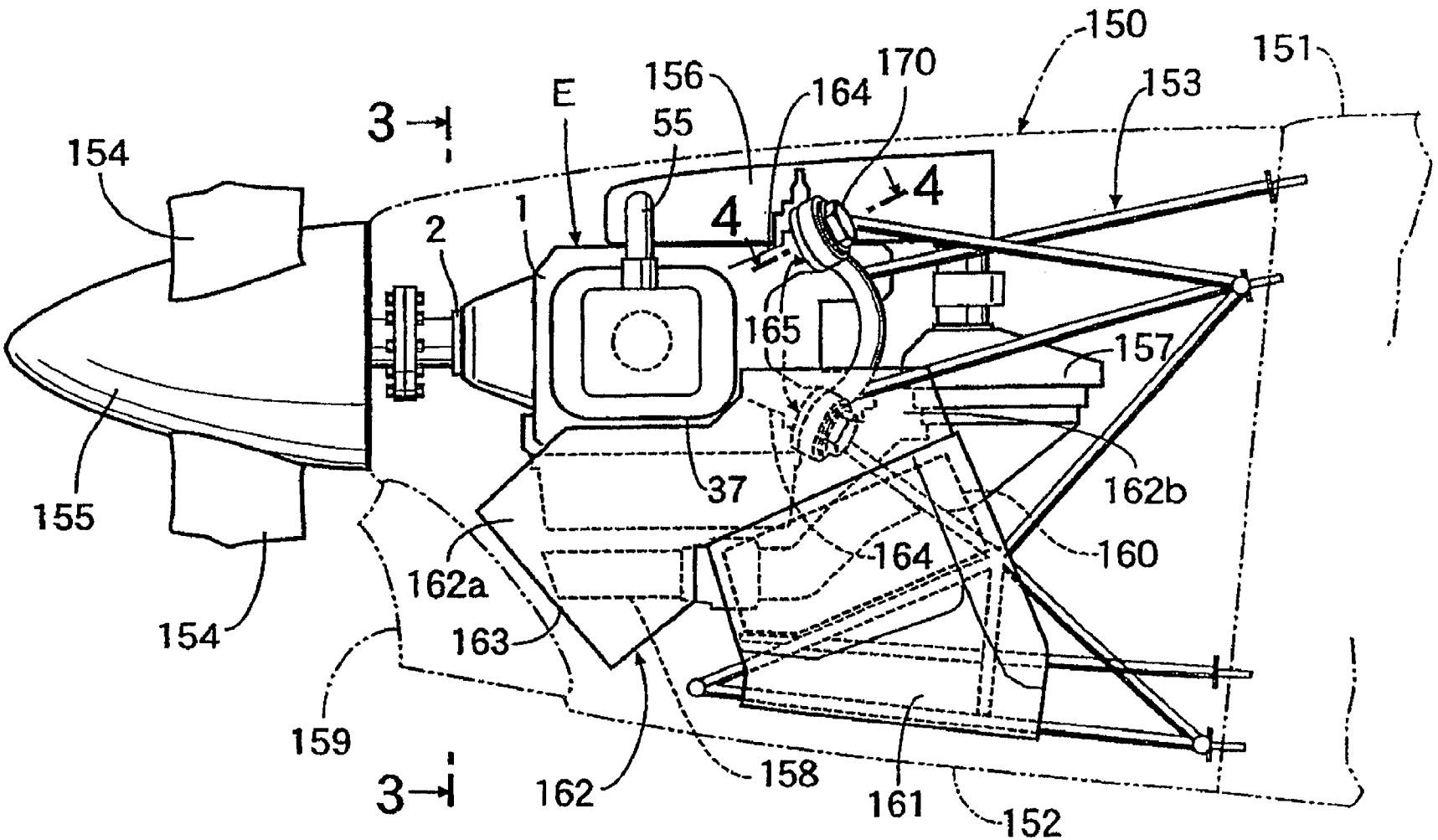
FIG. 2 is a side view of the engine mounted on an aircraft.
Figure 3:
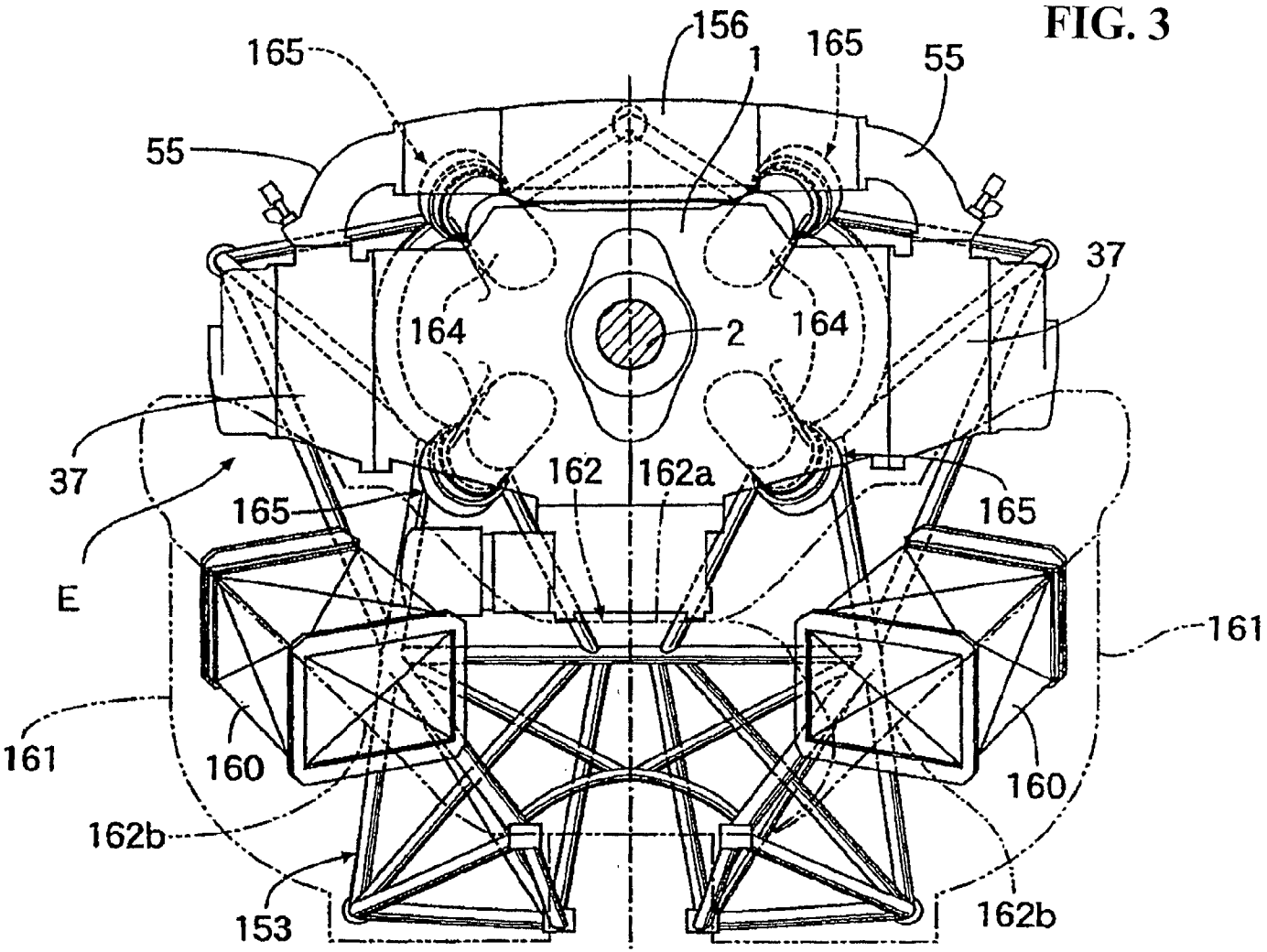
FIG. 3 is a cross-sectional view along the line 3—3 in FIG. 2.
Figure 4:
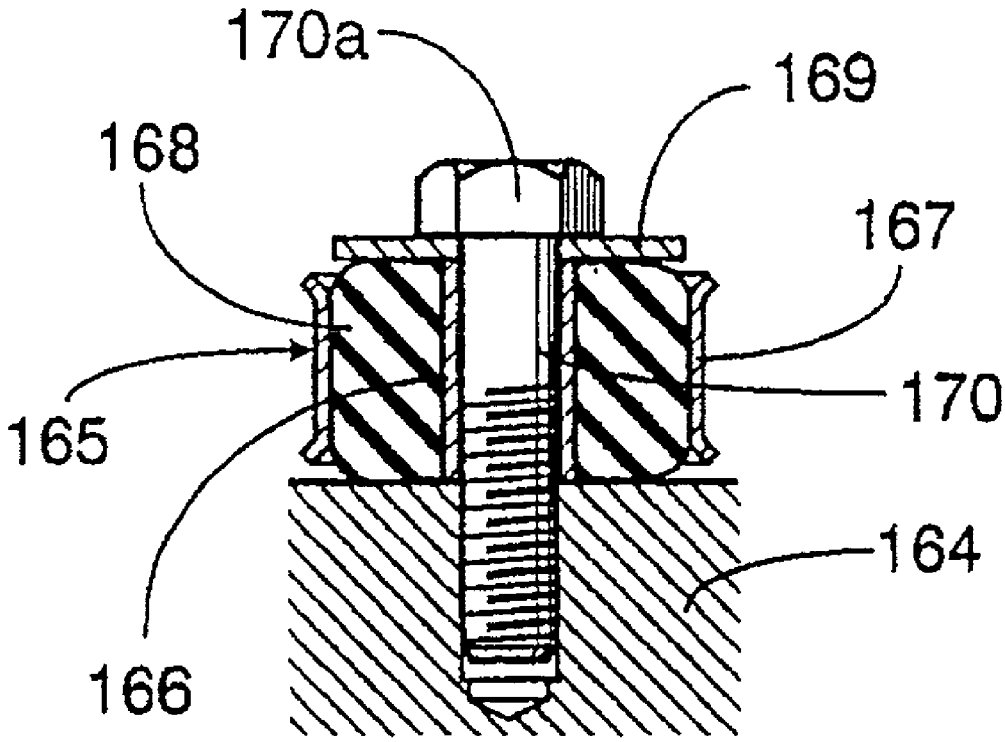
FIG. 4 is an enlarged cross-sectional view along the line 4—4 in FIG. 2.

FIGS. 1 to 4 show a working example of the present invention. FIG. 1 is a cross-sectional view of a part of the structure of an engine. FIG. 2 is a side view of the engine mounted on an aircraft. FIG. 3 is a cross-sectional view along a line 3—3 in FIG. 2. FIG. 4 is an enlarged cross-sectional view along a line 4—4 in FIG. 2.

First, in FIG. 1, the engine E is a horizontally opposed multi-cylinder engine having e.g. 2 cylinders. The engine E can be mounted on a vehicle, for example, an automobile, a motorcycle, an aircraft and the like. In the engine E, large ends of connecting rods 4 are respectively coupled to plural crank pins 2*a* of a crankshaft 2 rotatably supported in a crankcase 1. Small ends of the respective connecting rods 4 are coupled to pistons (not shown) respectively slidably engaged in plural cylinder bores 3 partially overlapped with each other in a plane projection including an axial line of the crankshaft 2.

One end of the crankshaft 2 projects from the crankcase 1. A rotor 6 of a generator 5 is coaxially coupled to the one end of the crankshaft 2. A stator 7 of the generator 5 is fixedly supported by a support plate 8 fixed to the crankcase 1. Furthermore, a cover 9 for covering the generator 5 is fastened to the crankcase 1.

A first gear 10 is fixed to the crankshaft 2 between the crankcase 1 and the support plate 8. A rotary shaft 12 is rotatably supported by the crankcase 1 and the support plate 8. A second gear 11 is fixed to the rotary shaft 12 and is engaged with the first gear 10. Furthermore, a third gear 13 is integrally formed with the rotary shaft 12. The third gear 13 is engaged with a fourth gear 14 connected to a valve device 45.

A water pump 15 is attached to the cover 9. A pump shaft 16 of the water pump 15 is connected, coaxially and relatively-unrotatable, to the rotary shaft 12. Rotation power from the crankshaft 2 is transmitted to the water pump 15 via. the first gear 10, the second gear 11 and the rotary shaft 12.

A gear case 17 is constructed by connecting a pair of case members 18 and 19 together. The gear case 17 is connected to the cover 9. A starter motor 21, which rotates by electric power supplied from a battery 20, is provided outside the crankcase 1. The starter motor has a rotation axial line parallel to the crankshaft 2 and is supported by the gear case 17. A starting power transmission 22 is provided between the starter motor 21 and the crankshaft 2.

The starting power transmission 22 includes a deceleration gear array 23 accommodated in the gear case 17 so as to decelerate and transmit the output from the starter motor 21. A one-way clutch 24 is accommodated in the gear case 17. A damper spring 25 is provided between the deceleration gear array 23 and the one-way clutch 24. A flywheel 26 is fastened to a clutch outer member 33 as a clutch member constructing a part of the one-way clutch 24. A rotary shaft 27 is coaxially connected to the flywheel 26. Furthermore, a fifth gear 28 is integrally formed with the rotary shaft 27 such that the fifth gear engages with the first gear 10 of the crankshaft 2.

A cylindrical shaft 31*a* of a gear 31 is rotatably supported by a support shaft 30, which has both ends supported in the gear case 17. The cylindrical shaft 31*a* is press-inserted in a gear 29, which constructs a part of the deceleration gear array 23. The shaft 31*a* can be slid into to the gear 29 upon input of excessive torque by surface processing on the shaft 31*a*. Specifically, the shaft 31*a* and the gear 29 construct a torque limiter mechanism.

The one-way clutch 24 has a clutch inner member 32 coupled to the deceleration gear array 23 via the damper spring 25 and the clutch outer member 33. The one-way clutch 24 transmits rotation power in one direction, inputted into the clutch inner member 32 from the deceleration gear array 23 side, to the clutch outer member 33 side. When a revolution speed in the one direction of the clutch outer member 33 connected to the crankshaft 2 exceeds the revolution speed of the clutch inner member 32 during startup of the engine E, the clutch blocks power transmission between the clutch inner member 32 and the clutch outer member 33.

The rotary shaft 27 is rotatably supported by the crankcase 1 and the cover 9. The rotary shaft 27 has one end projecting into the gear case 17. The flywheel 26 is spline-coupled to the one end of the rotary shaft 27 in the gear case 17. Furthermore, a bolt 34, which is engaged with an outer surface of the flywheel 26, is engaged with the rotary shaft 27.

The fifth gear 28 has a diameter smaller than that of the first gear 10. The fifth gear 28 is integrally formed with the other end of the rotary shaft 27 and is engaged with the first gear 10 of the crankshaft 2. The flywheel 26 and the clutch outer member 33, which rotate with the rotary shaft 27, are always coupled to the crankshaft 2. The flywheel 26 and the clutch outer member 33 rotate at a speed higher than that of the crankshaft 2.

A relay 36 is provided between the starter motor 21 and the battery 20. Power supply and supply stoppage from the battery 20 to the starter motor 21, i.e., actuation and stoppage of actuation of the starter motor 21 is controlled by connection/disconnection of the relay 36 in correspondence with connection/disconnection of a starter switch 35.

Exhaust valves 38 are openably/closably provided in respective cylinders of a cylinder head 37 of the engine E. The exhaust valve 38 is opened/closed by the valve device 45. The valve device 45 includes a holder 40. A lifter housing 39 is coaxial with an opening/closing actuation axial line of the exhaust valve 38, and is fixed to the cylinder head 37. A rocker arm 42 is swingably supported by a rocker shaft 41 fixedly supported by the holder 40. A push rod 43 applies an upward pressing force to one end of the rocker arm 42. A lifter 44 is located between the other end of the rocker arm 42 and the exhaust valve 38. The lifter 44 is slidably engaged in the lifter housing 39.

A decompression cam 46 is engaged with an engaging arm 42*a* provided on the other end side of the rocker arm 42 in the valve device 45. The decompression cam 46 and a solenoid 47 construct a decompression device 48. The solenoid 47 acts as an actuator coupled to the rotatable decompression cam 46.

The decompression device 48 depresses and opens the exhaust valve 38 by rotation of the decompression cam 46 through actuation of the solenoid 47. The actuation of the solenoid 47 is controlled by the controller 49.

The starter switch 35 is connected to the controller 49 for detection of the actuation period of the starter motor 21. Furthermore, a detection value from the revolution detector 52 is inputted into the controller 49. The revolution detector 52 is attached to the cover 9 in a position opposite to the outer peripheral surface of the rotor 6 in the generator 5, and detects the number of revolutions of the crankshaft 2.

The controller 49 starts the actuation of the solenoid 47 in accordance with the actuation of the starter motor 21 to depress the exhaust valve 38 to open the exhaust valve 38. The controller 49 continues the actuation of the solenoid 47 until the number of revolutions detected by the revolution detector 52 reaches a predetermined number of revolutions, which is a sufficiently high value. Accordingly, controller 49 controls the actuation of the solenoid 47.

Furthermore, the controller 49 controls actuation of an ignition device 50 to ignite ignition plugs 51, 51 of the engine E. It is desirable that the controller 49 control the ignition device 50 to start ignition of the ignition plugs 51 in correspondence with stoppage of actuation of the solenoid 47, i.e. stoppage of actuation of the decompression device 48. It is desirable that, similar to the ignition start timing of the ignition plugs 51, fuel injection start timing by a fuel injection valve (not shown) is determined after the stoppage of actuation of the decompression device 48.

In a case where this engine E is mounted on an aircraft 150 as shown in FIG. 2, the engine E is accommodated in a cowl 152 attached to a front part of body 151 such that the axial line of the crankshaft 2 is set along in frontward/rearward directions. The engine E is elastically supported by a support frame 153 provided in the cowl 152.

A spinner 155 having plural propellers 154 is provided in front of the cowl 152. The crankshaft 2 of the engine E is coaxially coupled to the spinner 155.

Referring to FIG. 3, an intake manifold 156 extending in the frontward/rearward directions is provided above the engine E. Both front sides of the intake manifold 156 are connected to left and right cylinder heads 37, 37 of the engine E via intake pipes 55, 55.

Furthermore, an air cleaner 157 is connected to a rear part of the intake manifold 156. The air cleaner is provided on the rear side from the engine E and in a position rear and below the intake manifold 156. A suction pipe 158 is connected to a lower part of the air cleaner 157. The suction pipe 158 extends below the engine E to the front side thereof. A front end of the suction pipe 158 is open to a screen 159 provided in a front lower end part of the cowl 152.

Radiators 160, 160 are provided on both left and right sides of a lower part of the engine E. The radiators 160, 160 are accommodated in a pair of first air ducts 161, 161 extending frontward and upward. Lower ends of the first air ducts 161, 161 are open toward a diagonally rear direction in the cowl 152. A second air duct 162 is connected to upper ends of the first air ducts 161, 161. The second air duct 162 has a common duct 162*a* with an air intake port 163 facing the screen 159 in a front-end central portion, extending leftward/rightward below a front part of the engine E. A pair of branch ducts 162*b*, 162*b* are connected to the upper ends of the first air ducts 161, 161. The branch ducts 162*b*, 162*b* extend rearward and upward from left and right ends of the common duct 162*a*.

Specifically, the radiators 160, 160 are provided on the left and right sides of the lower part of the engine E and are cooled by air from the screen 159 at the front end of the cowl 152. The air is pressed from the propellers 154 to the air intake port 163, and passed from the second air duct 162 to the left and right first air ducts 161, 161.

The support frame 153 is formed by combining, e.g. plural pipe members so as to hold the engine E from a rear position. On the other hand, attachment arms 164, 164 are provided such that the arms are positioned at respective corners of virtual right rectangle with, e.g. the axial line of the crankshaft 21 as a center in a plane orthogonal to the axial line, in e.g. four positions in a rear part of a crankcase 19 of the engine E. The attachment arms 164, 16 are inclined such that a distance therebetween increases as the arms are positioned toward the rear side. The attachment arms 164, 164 are attached to the support frame 153 via elastic mounts 165, 165.

Referring to FIG. 4, the elastic mount 165 include a cylindrical collar 166, a cylindrical support pipe 167 coaxially surrounding the collar 166, fixed to the support frame 153, and mount rubber 168. The mount rubber 168 is inserted between the collar 166 and the support pipe 167, with inner and outer peripheries hardened to an outer periphery of the collar 166 and an inner periphery of the support pipe 167. The ends of the collar 166 project from the ends of the support pipe 167.

A pressing plate 169 is brought into contact with one end of the collar 166. The other end of the collar is in contact with the attachment arm 164. Thus, a bolt 170 with an enlarged-diameter head 170*a* is engaged with the attachment arm 164 of the engine E. The bolt 170 engages an outer surface of the pressing plate 169, and is inserted through the pressing plate 169 and the collar 166. The attachment arm 164, i.e. the engine E is elastically attached to the support frame 153 by tightening the bolt 170.

The operation of the embodiment according to the present invention will now be described. When the actuation of the starter motor 21 is started by bringing the starter switch 35 into conduction so as to start the engine E, the power from the starter motor 21 is transmitted via the starting power transmission 22 to the crankshaft 2. In correspondence with the actuation of the starter motor 21, the controller 49 actuates the solenoid 47 of the decompression device 48, and the exhaust valve 38 is depressed and thereby opened by the decompression cam 46. Accordingly, the pressure in the combustion chamber during a compression stroke of the engine E is reduced, and the starting torque of the engine E can be greatly reduced. Furthermore, the open state of the exhaust valve 38 depressed by the decompression device 48 ends when the number of revolutions of the crankshaft 2 has reached a predetermined number of revolutions and the crankshaft 2 has sufficient inertia even when the pressure in the combustion chamber during the compression stroke of the engine E increases to a normal state. Accordingly, the engine E can be reliably started, and the starting torque necessary upon startup of the engine E can be reduced.

The decompression device 48 continues actuation until the number of revolutions of the crankshaft 2 reaches the predetermined number of revolutions regardless of ignition timing. Accordingly, downsizing and weight reduction of the starter motor 21 and the starting power transmission 22 can be attained even in a multicylinder engine E such as a 2-cylinder engine.

Furthermore, the starting power transmission 22 is provided with a one-way clutch 24 having the clutch outer member 33, which rotates at a speed higher than that of the crankshaft 2 and which is always coupled to the crankshaft 2, as one constituent. The comparatively large inertia produced by the clutch outer member 33 can be effectively utilized as the inertia of the crankshaft 2, thereby the startup of the engine E can be improved. Especially, as in the case of this embodiment where the flywheel 26 is fastened to the clutch outer member 33, the greater inertia produced by the clutch outer member 33 and the flywheel 26 is effectively utilized as inertia of the crankshaft 2, thereby the startup of the engine E can be further improved.

Furthermore, if it is arranged such that the ignition of the ignition plugs 51 is started and fuel injection is started, in correspondence with the stoppage of actuation of the decompression device 48, the startup of the engine E can be further improved.

As described above, the embodiment of the present invention has been described, however, the present invention is not limited to the above embodiment, but various design changes may be made without departing from the present invention described in the scope of the claims.

For example, a multi-cylinder engine E has been described in the above embodiment; however, the present invention is also applicable to a mono-cylinder engine.

As described above, according to the present invention, the starting torque of the engine is greatly reduced by reducing the pressure in the combustion chamber during the compression stroke of the engine until the number of revolutions of the crankshaft reaches a predetermined number of revolutions. Thus, the engine can be reliably started, and the downsizing and weight reduction of the starter motor and starting power transmission can be attained even in a multicylinder engine.

Furthermore, the comparatively large inertia produced by the clutch member as one constituent of the one-way clutch is effectively utilized as inertia of the crankshaft. Accordingly, the startup of the engine E can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine starting apparatus, comprising: actuating means;

decompression means for depressing an exhaust valve of the engine via a rocker arm and a lifter of the engine to open the exhaust valve, in correspondence with actuation of said actuating means, the lifter being located between the rocker arm and the exhaust valve and slidably engaged in a lifter housing;

a revolution detecting means for detecting a number of revolutions of a crankshaft of the engine; and control means for controlling the actuation of said actuating means, said control means starting the actuation of said actuating means in accordance with the actuation of a starter motor of the engine and continuing the actuation of said actuating means until the number of revolutions detected by said revolution detecting means reaches a predetermined number of revolutions.

2. The engine starting apparatus according to claim 1, further comprising starting power transmission means for decelerating rotation power of the starter motor and transmitting the power to the crankshaft, said power transmission means being operably mountable between the starter motor and the crankshaft.

3. The engine starting apparatus according to claim 1, wherein said control means is operably connected to an ignition means, said control means controlling the ignition means to start ignition of the engine, in correspondence with stoppage of actuation of said actuating means.

4. The engine starting apparatus according to claim 2, wherein said control means is operably connected to an ignition means, said control means controlling the ignition means to start ignition of the engine, in correspondence with stoppage of actuation of said actuating means.

5. The engine starting apparatus according to claim 1, wherein said control means is operably connected to a fuel injection means, said control means controlling the fuel injection means to start fuel injection into the engine, in correspondence with stoppage of actuation of said actuating means.

6. The engine starting apparatus according to claim 2, wherein said control means is operably connected to a fuel injection means, said control means controlling the fuel injection means to start fuel injection into the engine, in correspondence with stoppage of actuation of said actuating means.

7. An engine starting apparatus, comprising:

an actuator;

a decompression device, said decompression device being operable to depress an exhaust valve of the engine via a rocker arm and a lifter of the engine to open the exhaust valve, in correspondence with actuation of said actuator, the lifter being located between the rocker arm and the exhaust valve and slidably engaged in a lifter housing;

a revolution detector, said revolution detector for detecting a number of revolutions of a crankshaft of the engine; and a controller, said controller controlling the actuation of said actuator to start actuation in accordance with the actuation of a starter motor of the engine and continue actuation until the number of revolutions detected by said revolution detector reaches a predetermined number of revolutions.

8. The engine starting apparatus according to claim 7, further comprising a starting power transmission, said starting power transmission for decelerating rotation power of the starter motor and transmitting the power to the crankshaft, said power transmission being operably mountable between the starter motor and the crankshaft.

9. The engine starting apparatus according to claim 7, wherein said controller is operably connected to an ignition device, said controller controlling the ignition device to start ignition of ignition plugs of the engine, in correspondence with stoppage of actuation of said actuator.

10. The engine starting apparatus according to claim 8, wherein said controller is operably connected to an ignition device, said controller controlling the ignition device to start ignition of ignition plugs of the engine, in correspondence with stoppage of actuation of said actuator.

11. The engine starting apparatus according to claim 7, wherein said controller is operably connected to a fuel injection valve, said controller controlling the fuel injection valve to start fuel injection into the engine, in correspondence with stoppage of actuation of said actuator.

12. The engine starting apparatus according to claim 8, wherein said controller is operably connected to a fuel injection valve, said controller controlling the fuel injection valve to start fuel injection into the engine, in correspondence with stoppage of actuation of said actuator.

13. The engine starting apparatus according to claim 8, wherein said starting power transmission includes a one-way clutch, said one-way clutch includes a clutch member as one constituent that rotates at a speed higher than that of the crankshaft, said one-way clutch is operably mountable to the crankshaft to be always coupled therewith.

14. The engine starting apparatus according to claim 7, wherein said decompression device includes a decompression cam, said decompression cam being operably engageable with an engaging arm of a the rocker arm, said decompression cam being operably connected to said actuator and rotatable upon actuation of said actuator to open the exhaust valve.

15. The engine starting apparatus according to claim 8, wherein said decompression device includes a decompression cam, said decompression cam being operably engageable with an engaging arm of a the rocker arm, said decompression cam being operably connected to said actuator and rotatable upon actuation of said actuator to open the exhaust valve.

16. An engine starting apparatus, comprising: an actuator;

a decompression device, said decompression device being operable to depress an exhaust valve of the engine to open the exhaust valve, in correspondence with actuation of said actuator;

a revolution detector, said revolution detector for detecting a number of revolutions of a crankshaft of the engine;

a controller, said controller controlling the actuation of said actuator to start actuation in accordance with the actuation of a starter motor of the engine and continue actuation until the number of revolutions detected by said revolution detector reaches a predetermined number of revolutions; and a starting power transmission, said starting power transmission for decelerating rotation power of the starter motor and transmitting the power to the crankshaft, said power transmission being operably mountable between the starter motor and the crankshaft, said starting power transmission comprising:

a deceleration gear array for decelerating power from the starter motor;

a one-way clutch;

a damper spring, said damper spring being mounted between said deceleration gear array and an inner member of said one-way clutch;

a flywheel, said flywheel being fastened to an outer member of said one-way clutch; a rotary shaft coaxially connected to said flywheel; and a gear, said gear being mounted on said rotary shaft and operably connectable to the crankshaft, wherein said clutch inner member transmits power from said deceleration gear array to said clutch outer member when the number of revolutions of the clutch inner member is greater than the number of revolutions of the clutch outer member.

17. The engine starting apparatus according to claim 16, wherein said deceleration gear array comprises:

a support shaft; and a first gear, said gear including a cylindrical shaft rotatably supported by said support shaft, said first gear being operably connected to said clutch inner member;

a second gear, said second gear being mounted for rotation with said first gear by being press-inserted on an outside of said cylindrical shaft, said second gear being operably connectable with a gear of the starter.

18. The engine starting apparatus according to claim 7, wherein said decompression device is a cam.

19. The engine starting apparatus according to claim 7, wherein said decompression device is an exhaust valve decompression device and said actuator is connected to only said exhaust valve decompression device.

20. An engine starting apparatus, comprising:

a decompression cam, said decompression cam being operable to depress an exhaust valve of the engine to open the exhaust valve;

an actuator, said actuator being operable to actuate said decompression cam;

a revolution detector, said revolution detector for detecting a number of revolutions of a crankshaft of the engine;

a controller, said controller controlling the actuation of said actuator to start actuation in accordance with the actuation of a starter motor of the engine and continue actuation until the number of revolutions detected by said revolution detector reaches a predetermined number of revolutions; and a starting power transmission, said starting power transmission for decelerating rotation power of the starter motor and transmitting the power to the crankshaft, said power transmission being operably mountable between the starter motor and the crankshaft, wherein said starting power transmission includes a one-way clutch, said one-way clutch includes a clutch member as one constituent that rotates at a speed higher than that of the crankshaft, said one-way clutch is operably mountable to the crankshaft to be always coupled therewith.

21. The engine starting apparatus according to claim 20, wherein said controller is operably connected to an ignition device, said controller controlling the ignition device to start ignition of ignition plugs of the engine, in correspondence with stoppage of actuation of said actuator.

22. The engine starting apparatus according to claim 20, wherein said controller is operably connected to a fuel injection valve, said controller controlling the fuel injection valve to start fuel injection into the engine, in correspondence with stoppage of actuation of said actuator.

23. The engine starting apparatus according to claim 20, wherein said decompression cam is operably engageable with an engaging arm of a rocker arm of the engine, said decompression cam being operably connected to said actuator and rotatable upon actuation of said actuator to open the exhaust valve.

24. The engine starting apparatus according to claim 20, wherein said decompression cam is an exhaust valve decompression cam and said actuator is connected to only said exhaust valve decompression cam.

25. The engine starting apparatus according to claim 20, wherein said actuator is a solenoid.

26. The engine starting apparatus according to claim 20, wherein said decompression cam engages a rocker arm of the engine via an engaging arm provided on the rocker arm.

* * * * *